US005645905A

United States Patent [19]

Takubo et al.

[11] Patent Number: 5,645,905

[45] Date of Patent: Jul. 8, 1997

[54] SNAP ZIPPER

[75] Inventors: Toyokazu Takubo; Ken-ichi Tanaka, both of Himeji, Japan

[73] Assignee: Idemitsu Petrochemical Co., Ltd., Tokyo, Japan

[21] Appl. No.: 541,624

[22] Filed: Oct. 10, 1995

Related U.S. Application Data

[63] Continuation-in-part of Ser. No. 147,876, Nov. 4, 1993, abandoned.

[30] Foreign Application Priority Data

Nov. 9, 1992 [JP] Japan ..... 4-298624
Nov. 9, 1992 [JP] Japan ..... 4-298625

[51] Int. Cl.[6] ..... B65D 33/25

[52] U.S. Cl. ..... 428/35.7; 428/33; 220/213; 220/253; 220/350; 383/97

[58] Field of Search ..... 428/34.1, 33, 35.7, 428/36.9; 220/213, 253, 350, DIG. 11; 383/97

[56] References Cited

FOREIGN PATENT DOCUMENTS 0 339 324 11/1989 European Pat. Off. .
0 371 402 6/1990 European Pat. Off. .
0 398 731 11/1990 European Pat. Off. .
0 480 605 4/1992 European Pat. Off. .

OTHER PUBLICATIONS

Patent Abstracts of Japan, vol. 015, No. 416 (M–1172), 23 Oct. 1991 & JP–A–03 176365 (Idemitsu Petrochem Co), 31 Jul. 1991 (Abstract).

*Primary Examiner*—Charles Nold
*Attorney, Agent, or Firm*—Flynn, Thiel, Boutell & Tanis, P.C.

[57] ABSTRACT

A snap zipper includes strip-male and strip-female members, and at least its portion for fusing to a bag body is made of a material mainly composed of a polyester type elastomer or a polybutylene terephthalate (PBT) resin and that the resin of the portion for fusion has a bending modulus of elasticity of 10,000 kg/cm$^2$ or below. At least its portion for fusion is made of a material having a composition including polyester type elastomer and a polyolefin type resin or polybutylene terephthalate (PBT) resin and a polyolefin type resin and the content of the polyolefin type resin in the composition is 3 to 50% by weight. In case of the snap zipper adapted to have a portion for fusing to the bag body and the male and female members, excepting the portion for fusion, the portion for fusion may be composed of copolymer of ethylene and acrylic acid ester or copolymer of ethylene and methacryic acid ester.

11 Claims, 3 Drawing Sheets

SNAP ZIPPER

This application is a continuation-in-part of U.S. Ser. No. 08/147 876, filed Nov. 4, 1993, now abandoned.

BACKGROUND OF THE INVENTION

1. Field of the Invention

This invention relates to a snap zipper, which can be utilized in the fields of food packaging and medical products.

2. Description of the Related Art

Bags with zipper are used in many fields such as those of food packaging and medical products. In a bag with a snap zipper, a strip-like snap zipper comprising a male and a female member is provided on the bag at a sealing portion thereof. Heretofore, various methods of producing bags with snap zippers have been proposed.

Among the proposed methods, there are (1) one, in which a cylindrical film with a male and a female portion of a snap zipper is extrusion formed as a one-piece molding by using extrusion dies, and (2) one, in which a tape with a snap zipper is produced and is thermally fused to a base film for forming a bag body.

In the former method (1), the bag with a snap zipper, which is produced as a one-piece molding from the outset, takes space due to the shape of the snap zipper. Its storage and handling, therefore, are rather inconvenient. In addition, restrictions are imposed on the structure of the base film. Accordingly, the latter method (2) which is free from the above drawbacks has recently become a popular method.

The snap zipper is usually made of low density polyethylene (LDPE) or polypropylene (PP). In many cases, a sealant layer (which forms the innermost layer of the bag body, and to which the snap zipper is fused), is applied to a base film of the same material. For example, with a base film sealant layer of LDPE, the snap zipper is made of the same LDPE.

With a sealant layer of the same material as the snap zipper, the snap zipper can be sealed to the sealant layer without any trouble.

Meanwhile, polyester resins, polyamide resins, ethylene-vinyl-alcohol copolymerization resins, and so forth have excellent heat resistance, retention properties and order gas-barrier, and thus they are used suitably as the material of the sealant layer of the bag body.

However, since a sealant layer of a polyester type resin is a different material from the snap zipper, sufficient adhesion for fusing the snap zipper can not be obtained. Therefore, it has been difficult to use polyester type resins for the sealant layer.

SUMMARY OF THE INVENTION

A snap zipper according to the first aspect of the invention features that at least its portion for fusing to a bag body is made of a material mainly composed of a polyester type elastomer or a polybutylene terephthalate (PBT) resin and that the resin of the portion for fusion has a bending modulus of elasticity of 10,000 kg/cm$^2$ or below.

Only the portion for fusion need be mainly composed of the PBT resin or polyester type elastomer. Of course, the entire snap zipper including the portion for fusion may be mainly composed of the PBT resin or polyester type elastomer.

If the bending modulus of elasticity of the resin of the portion for fusion is above 10,000 kg/cm$^2$, adequate flexibility necessary for the snap zipper can not be obtained. Generally, the lower the bending modulus of elasticity of the resin, the lower the melting points of the PBT resin and polyester type elastomer, and correspondingly, the temperature of fusion to the sealant layer is lower.

A snap zipper according to the second aspect of the invention features that at least its portion for fusion is made of a material having a composition including (1) polyester type elastomer and a polyolefin type resin or (2) polybutylene terephthalate (PBT) resin and a polyolefin type resin and that the content of the polyolefin type resin in the composition is 3 to 50% by weight.

Only the portion for fusion need be mainly composed of the aforementioned (1) or (2). Of course, the entire snap zipper including the portion for fusion may be mainly composed of the aforementioned (1) or (2).

Among the polyolefin varieties are low-density polyethylene (LDPE), linear low-density polyethylene (L-LDPE), high-density polyethylene (HDPE), ethylene-vinyl acetate copolymer (EVA), polypropylene (PP), ethylene-butene-1 copolymer, ethylene-propylene copolymer, polybutadiene (PBd), etc..

The snap zipper may, if necessary, contain usually added additives (such as a coloring agent, a stabilizing agent, an anti-oxidization agent, a slip agent, an anti-static agent, an anti-blocking agent, etc.) as materials except the PBT resin or polyester type elastomer. Slip agents are usually added.

According to the invention, there is provided a bag with a snap zipper, in which the snap zipper is fused via the portion for fusion to a bag body.

The snap zipper according to the first to third aspects of the invention permits the use of the polyester type resin for the bag body sealant layer, to which the snap zipper is fused. In this case, the snap zipper can be fused to the sealant layer without trouble. Besides, sufficient strength of fusion between the bag body and the snap zipper is obtainable.

For the snap zipper according to the invention, it is particularly suitable to use the polyester type resin as the material of the sealant layer.

Examples of the polyester type resin are polyester (PET), polybutylene terephthalate (PBT) resin, polyester type elastomers, polycarbonates, etc. It is possible to use a blended resin composed of polyester and polyolefin type resins.

Such polyester type resins have excellent heat resistance, odor retention and low drug absorption properties. Use of these polyester type resins as the material of the sealant layer causes following effects.

Regarding the prior art snap zipper, aluminum has been used as the material of the bag body in order to provide the odor retention and low drug absorption properties. However, it is possible to permit cost reduction of the bag with the snap zipper by using polyester type resins in lieu of aluminum. Further, the bag may be made transparent by dispensing with an aluminum layer. By so doing, it is possible to obtain a bag, through which the contents can be seen while it provides odor retention and low drug absorption properties.

The bag produced by using such polyester type resins is suitable for fields in which heat resistance to boiling and retort is required.

As the material for the sealant layer, any resin may be used other than the polyester type resins so long as it can be fused to the snap zipper. Examples of such resins are LDPE, L-LDPE, PP, ethylene-vinyl acetate copolymer (EVA), ethylene-methacrylic acid copolymer (EMAA), ionomer (IO), etc..

As the decorative material, nylon, PET, PP, cellophane, paper, etc. may be used as desired depending on desired characteristics.

The snap zipper according to the invention may be fabricated by any method. Usually, it is produced using extrusion dies having sectional profiles corresponding to its shape for molding and then cooling the resultant molding in water.

Further, the shape of the snap zipper according to the invention is not limited to male and female members capable of chucking together, and any well-known shape may be adopted so long as it is capable of sealing and unsealing.

The snap zipper may be fused to the bag body with well-known means such as heat, high frequency waves, ultrasonic waves, etc.

One form of the snap zipper according to the present invention is a snap zipper with the portion for fusing to the bag body and the other portion for a strip-male member or a strip-female member, with the portion for fusing to the bag body made of a copolymer of ethylene and acrylic acid ester or a copolymer of ethylene and methacrylic acid ester.

The above copolymer of ethylene and acrylic acid ester or copolymer of ethylene and methacrylic acid ester is a kind of a polyester type elastomer.

The proportion of acrylic acid ester or methacrylic acid ester contained in the copolymer is connected with strength of adhering between the portion for fusion and the other portion for the strip-male member (or the strip-female member) or the bag body. Thus, there will be no disadvantage, practically, if the above proportion is defined as a value which causes the adhesion strength of adhering between the portion for fusion and the other portion for the strip-male member (or strip-female member) to be larger than the engagement strength of engaging the male member with the female member.

Considering the aforementioned points, the proportion of acrylic acid ester or methacrylic acid ester contained in the copolymer should be defined as, for example, a value of 5.0–40.0 wt %, more preferably 15.0–25.0 wt %. If the proportion is below 5.0 wt %, it is possible that detachment will occur on an interface between the face of the portion for fusion and the face of the other portion for the male or female member when the snap zipper is opened and closed repeatedly. If the proportion is above 40.0 wt %, a mutually fused performance of the portion for fusion and the other portion for the male or female member becomes inferior although the seal strength of sealing with films of the bag body is stronger.

It is advisable that the strip-male and strip-female members, except for the portion for fusion, are made of synthetic resin having a bending modulus of elasticity of 500–5,000 kg/cm$^2$.

When the bending modulus of elasticity of the strip-male and strip-female members, except for the portion for fusion, is less than the aforesaid region of the bending modulus of elasticity, the engagement strength decreases or it is difficult to produce the bag repeatedly. On the other hand, when the bending modulus of elasticity is more than the region, the engagement strength after opening and closing the bag repeatedly decreases or the snap zipper is damaged.

The snap zipper has an elongate stem portion formed with a two-layer structure of a first layer to be the portion for fusing to the bag body and a second layer laminated on the first layer, in which the first layer is composed of a copolymer of ethylene and acrylic acid ester.

It is possible that the elongate stem portion is formed as one layer to wholly be the portion for fusion. However, in order to prevent from fusing the stem portion of the male member with the stem portion of the female member when the bag is produced, it is desirable that the stem portion is formed to have a the two-layer structure.

A concrete example of copolymer of ethylene and acrylic acid ester as aforementioned is ethylene-acrylic acid methyl random copolymer (EMA) or ethylene-acrylic acid ethyl random copolymer (EEA). Incidentally, a specific example of copolymer of ethylene and methacrylic acid ester is ethylene-methacrylic acid methyl random copolymer (EMMA).

All those copolymers have a good adhesion with a polyester type resin such as a PBT type resin, and, considering odoriferosity, EMA and EMMA, more preferably EMMA, are suitable.

Material of the male and female members, excluding the portion for fusion, can use low-density polyethylene for reasons of rigidity and engagement performance.

Particularly, use of linear low-density polyethylene (L-LDPE) in the low-density polyethylene is desirable. The suitable MI of low-density polyethylene should be 1–15 g/10 min., more preferably 2–8 g/10min. A MI lower than 1 g/10 min. easily causes melt fracturing, on the other hand a MI higher than 15 g/10 min. causes the molding performance (shape retention) to be inferior.

For example, PP, EVA and EMMA, excluding LDPE, can be used for the male and female members, excluding the portion for fusion, but LDPE is generally used as a material of the snap zipper.

Incidentally, it is desirable that an adhesion resin layer is provided between the portion for fusing to the bag body and the male or female members as the portion, excepting the portion for fusion, in order to increase the adhesion strength of both of the portions.

DETAILED DESCRIPTION OF THE PREFERRED EMBODIMENT(S)

EMBODIMENT 1

Figure 1:
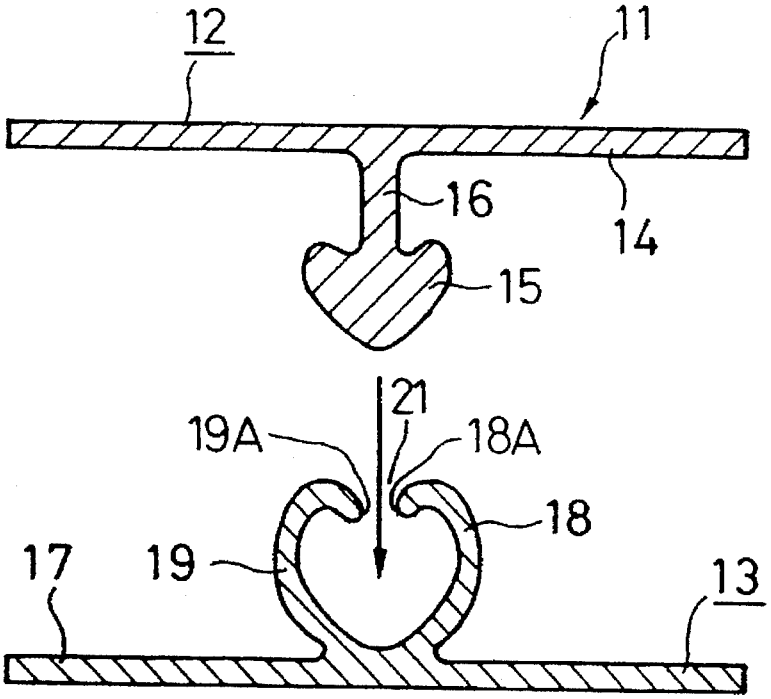
FIG. 1 is a sectional view showing a male and a female member of an embodiment of the zipper according to the invention in a unchucked state.
Figure 2:
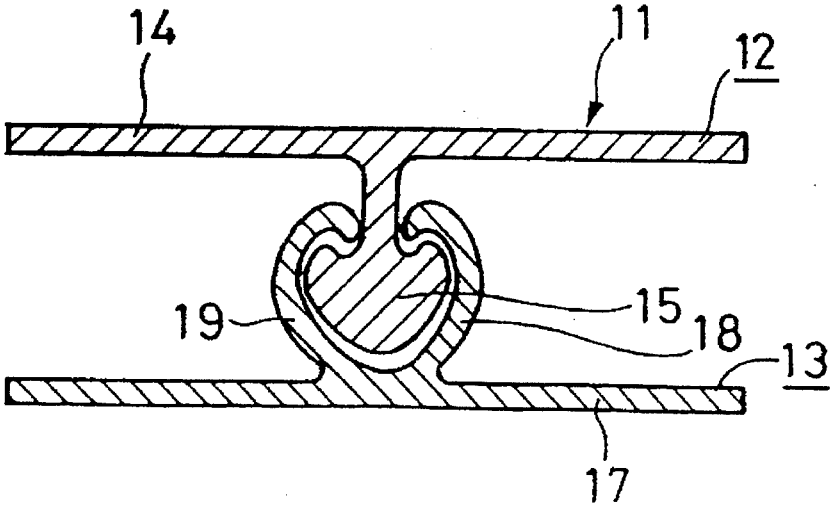
FIG. 2 is a sectional view showing the same embodiment of the zipper in the chucked state.

A strip-like male and also a strip-like female member 12 and 13 as an embodiment of a snap zipper 11, as shown in FIGS. 1 and 2, were produced by extrusion molding using PBT as a material resin with an extruder, followed by water cooling. These members were taken up into rolls. The bending modulus of elasticity of the PBT resin was 3,500 kg/cm$^2$.

The male member 12 is a one-piece molding and has a strip-like stem portion 14, a head portion 15 of a heart-like sectional profile and a connecting portion 16 having a rod-like sectional profile, which connects together the portions 14 and 15.

The female member 13 is also a one-piece molding and has a strip-like stem portion 17 serving as a portion to be fused, and a first and a second semicircular hook portion 18 and 19 formed on the stem portion 17 such that they face each other. The free ends 18A and 19A of the hook portions 18 and 19 define between them a gap 21 which has a width substantially corresponding to the thickness of the connecting portion 16.

Of these snap zippers 11, flexibility and engagement performance were evaluated. Further, the thermal fusion temperature was measured. The results are shown in Table 1.

The flexibility was evaluated with respect to the state of take-up of the male member 12 and the female member 13. The flexibility was A, i.e., satisfactory, if the rolls of the take-up male and female members 12 and 13 were satisfactory in appearance. It was B, i.e., common, if the rolls were rather satisfactory in appearance. It was F, i.e., defective, if the rolls were unsatisfactory in appearance.

The engagement performance was evaluated from how the male and female members 12 and 13 were engaged when the male member 12 and the female member 13 were abutted to one another, and then the hook portions 18 and 19 were pushed apart with the head portion 15 to cause the hook portion 15 to fit in between the hook portions 18 and 19, as shown in FIG. 1, 2.

The engagement performance was evaluated as such: It was A, i.e., satisfactory, if the male and female members 12 and 13 could be readily engaged. It was B, i.e., common, if the two members could be engaged. It was F, i.e., defective, if the two members could only be difficultly engaged or could not be engaged.

The thermal fusion temperature indicates a mechanical strength of 300 g per 15 mm of width. It was measured by using a thermal gradient tester ("HG-100" by Toyo Seiki Co., Ltd.).

Figure 3:
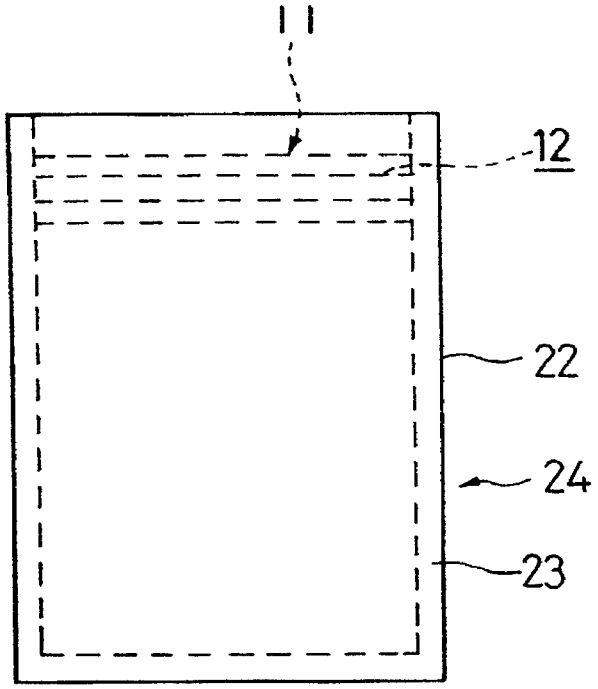
FIG. 3 is a front view showing an embodiment of the bag with a snap zipper according to the invention.
Figure 4:
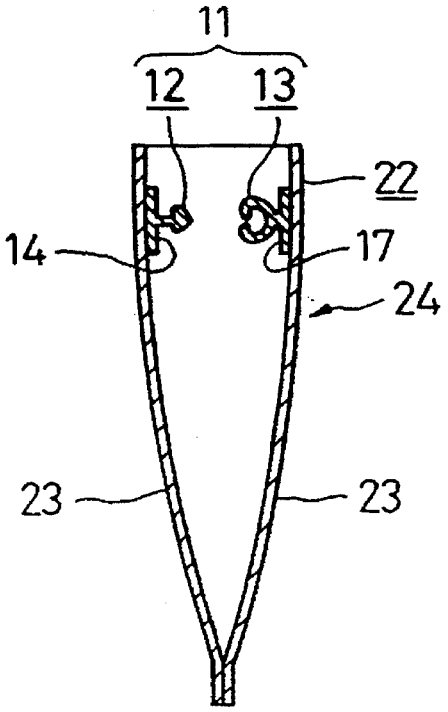
FIG. 4 is a sectional view showing the same embodiment of the bag with the snap zipper according to the invention.
Figure 5:
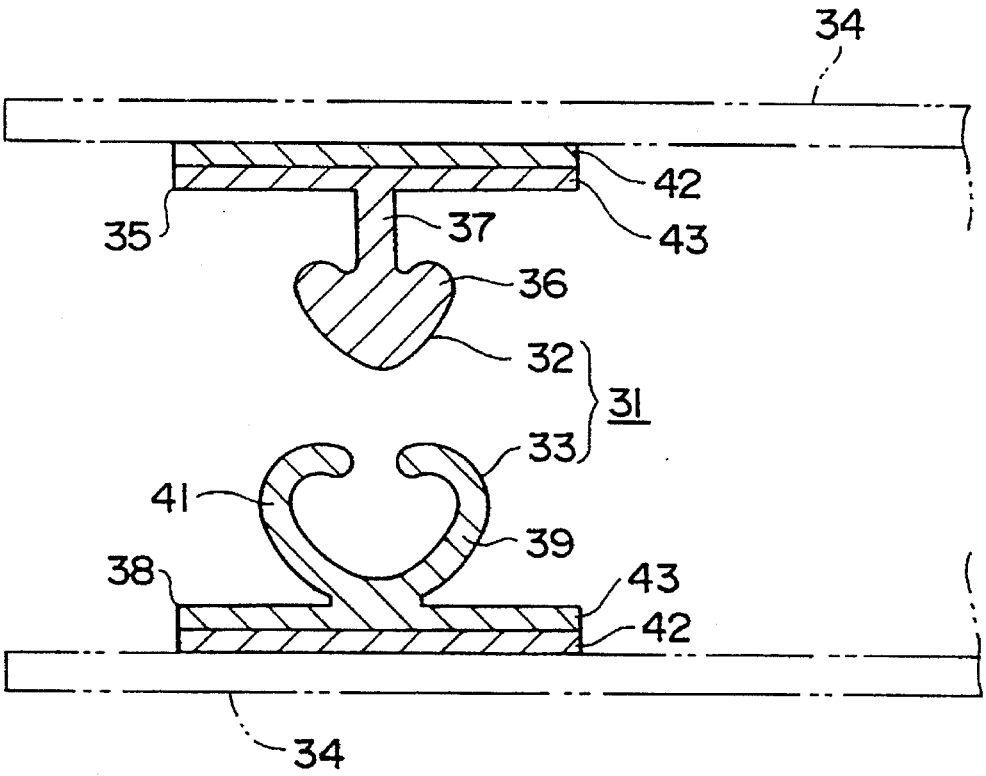
FIG. 5 is a sectional view showing a male and a female member of another embodiment of the zipper according to the invention in a unchucked state.
Figure 6:
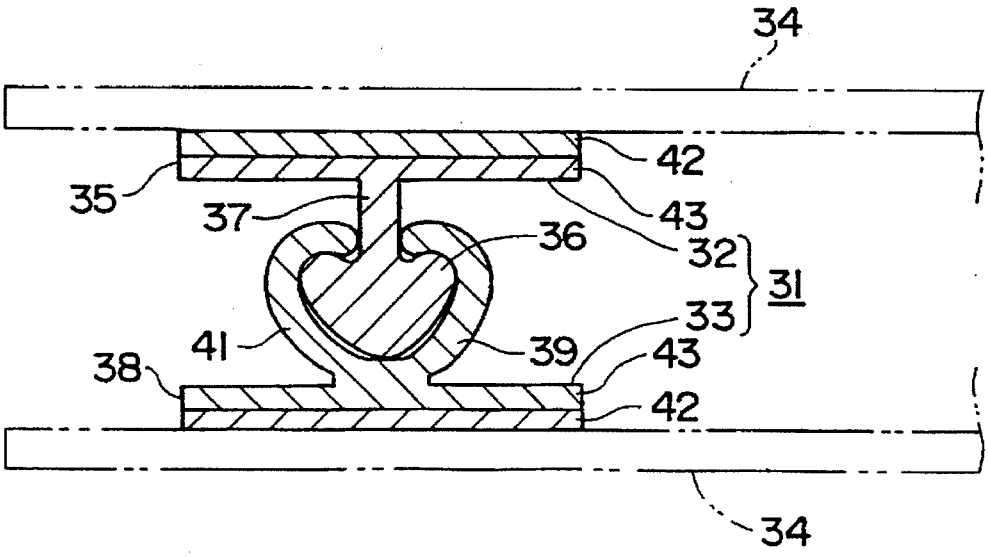
FIG. 6 is a sectional view showing another embodiment of the zipper in the chucked state.

Then, as shown in FIGS. 3 and 4, the stem portions 14 and 17 of the male and female members 12 and 13 were thermally fused to respective base films (70 μm thick) 23 of the bag body 22, and then three sides of the films were heat sealed, thus obtaining the embodiment of the bag 24 with a snap zipper.

The base film 23 had a five-layer structure having four inner layers, i.e., a polyester type resin layer (15 μm), a PET layer (26 μm), a polyester type resin layer (12 μm) and an adhesive layer (5 μm), and an outer layer, i.e., a PET layer (12 μm). The innermost polyester type resin layer served as the sealant layer of the bag body 22, to which the male or female member 12 or 13 was fused.

EMBODIMENTS 2 AND 3

Like Embodiment 1, the individual embodiments of snap zipper 11 were produced by a using PBT. Then, bags 24 with snap zipper according to the individual embodiments were produced by using the respective zippers 11.

Incidentally, the bending modulus of elasticity of the PBT resin are shown in Table 1.

Of these snap zippers 11, the flexibility and the engagement performance were evaluated as in Embodiment 1. Further, the thermal fusion temperature was measured. The results are shown in Table 1.

COMPARATIVE EXAMPLES 1 TO 5

Like Embodiment 1, individual comparative examples of a snap zipper 11 were produced. Then, bags with a snap zipper according to the individual comparative examples were produced by using the respective zippers.

Incidentally, the kinds and the bending modulus of elasticity of the resins used are shown in Table 1.

Of these snap zippers, the flexibility and engagement performance were evaluated as in Embodiment 1. Further, the thermal fusion temperature was measured. The results are shown in Table 1.

TABLE 1

| | | RESIN | BENDING MODULUS OF ELASTICITY | FLEXIBILITY | THERMAL FUSION TEMPERATURE | ENGAGEMENT PERFORMANCE |
|---|---|---|---|---|---|---|
| * | 1 | PBT | 3,500 kg/cm$^2$ | A | 182° C. | A |
| | 2 | PBT | 7,000 kg/cm$^2$ | A | 190° C. | A |
| | 3 | PBT | 10,000 kg/cm$^2$ | B | 198° C. | B |
| ** | 1 | PBT | 15,000 kg/cm$^2$ | F | 210° C. | F |
| | 2 | PBT | 25,000 kg/cm$^2$ | F | 227° C. | F |
| | 3 | PBT | 45,000 kg/cm$^2$ | F | 235° C. | F |
| | 4 | LDPE | — | — | DEFECTIVE THERMAL FUSION PERFORMANCE | A |
| | 5 | PP | — | — | DEFECTIVE THERMAL FUSION PERFORMANCE | A |

* = Embodiment.
** = Comparative Example.

Since the snap zippers 11 in Embodiments 1 to 3 are made of PBT resin having a bending modulus of elasticity of less than 10,000 kg/cm$^2$, they are satisfactorily flexible, excellent in the performance of sealing and unsealing of the male and female members 12 and 13 (engagement performance) and satisfactory in appearance.

Also, with the snap zippers of these embodiments, satisfactory fusion can be ensured by the sealant layer even if the sealant layer of the base film 23 of the bag body 24 is of a different material (polyester type resin) from that of the snap zipper 11, that is, the adhesion between the snap zipper 11 and sealant layer is satisfactory.

Further, since the temperature of fusion to the sealant layer is comparatively low, fusion can be readily attained. Thus, it is possible to increase the productivity. In addition, it is possible to obtain a bag 24 with a snap zipper 11 which has a satisfactory appearance.

With the zippers in Comparative Examples 1 to 3, which are made of PBT resin, the flexibility and the engagement performance are not satisfactory and the thermal fusion temperature is rather high since the bending modulus of elasticity is over 10,000 kg/cm$^2$.

With the zippers in Comparative Examples 4 and 5, which are made of LDPE or PP resin, the fusion performance is defective, although the engagement performance is satisfactory.

EMBODIMENTS 4 TO 8

Like Embodiment 1, the individual embodiments of snap zippers 11 made of a polyester type elastomer were produced. Then, bags 24 with a snap zipper according to the individual embodiments were produced by using the respective zippers 11.

In Embodiment 4, as a polyester type elastomer was used "PELPRENE" (trade name by Toyobo CO., Ltd.), and in Embodiment 5 to 8, as a polyester type elastomer was used "HYTREL" (trade name by DUPONT-TORAY CO., Ltd.).

The bending modulus of elasticity and the melting point of the polyester type elastomer are shown in Table 2.

Of these snap zippers 11, the flexibility and engagement performance were evaluated as in Embodiment 1. Further, the thermal fusion temperature was measured. The results are shown in Table 2.

COMPARATIVE EXAMPLES 6 TO 8

Like Embodiment 1, the individual embodiments of a snap zipper 11 were produced. Then, bags with a snap zipper according to the individual comparative examples were produced by using the respective zippers.

Incidentally, the bending modulus of elasticity and the melting point or the resin are shown in Table 2.

Of these snap zippers, the flexibility and engagement performance were evaluated as in Embodiment 1. Further, the thermal fusion temperature was measured. The results are shown in Table 2.

a polyester type elastomer as a main material and a polyolefin type resin as an auxiliary material, with an extruder, followed by water cooling. The kind and proportions of the polyolefin type resin that were used in the individual embodiments are as in FIG. 3.

The shape retention of the snap zippers 11 of the individual embodiments was evaluated. Also, the heat seal temperature was measured. The results are shown in Table 3.

The shape retention was evaluated such that B (Good) was satisfactory in the shape of the head of snap zipper 11 and the hook portions 18 and 19 and substantially free from twist in the stem portions (tape portions) 14 and 17, C (Fairly Good) had a slight twist in the stem portions 14 and 17, and F (Fail) had too much twist in the stem portions 14 and 17.

The heat seal temperature was measured in the same way as above.

In the evaluation column in the Table, B stands for a snap zipper, having a B or C in the shape retention and a heat seal strength of 15 mm width of 300 g or above, and F stands for a zipper, having C or F in the shape retention and a heat seal strength of 15 mm width of 300 g or below.

As shown in FIGS. 3 and 4, the stem portions 14 and 17 of the male and female members 12 and 13 were then heat sealed to base films (70 μm thick) 23 of the bag body 22, and then the bag 21 with the snap zipper in these embodiments.

TABLE 2

| | | RESIN | FLEXIBLE ELASTICITY RATE | MELTING POINT | FLEXICIBILITY | THERMAL FUSION TEMPERATURE | ENGAGEMENT PERFORMANCE |
|---|---|---|---|---|---|---|---|
| * | 4 | PELPRENE P-50MS | 3,500 kg/cm$^2$ | 170° C. | A | 182° C. | A |
| | 5 | HYTREL 4767 | 7,000 kg/cm$^2$ | 199° C. | A | 190° C. | A |
| | 6 | HYTREL 6347 | 10,000 kg/cm$^2$ | 215° C. | B | 198° C. | B |
| | 7 | HYTREL 7247 | 15,000 kg/cm$^2$ | 190° C. | F | 210° C. | F |
| | 8 | HYTREL 2571 | 25,000 kg/cm$^2$ | 225° C. | F | 227° C. | F |
| ** | 6 | HYTREL 2751 | 45,000 kg/cm$^2$ | 227° C. | F | 235° C. | F |
| | 7 | LDPE | — | — | — | DEFECTIVE THERMAL FUSION PERFORMANCE | A |
| | 8 | PP | — | — | — | DEFECTIVE THERMAL FUSION PERFORMANCE | A |

* = Embodiment.
** = Comparative Example.

Since the snap zippers 11 in Embodiments 4 to 8 are made of a polyester type elastomer having a flexible elasticity rate of less than 10,000 kg/cm$^2$, they have effects similar to the zippers made of PBT resin in Embodiments 1 to 3. Furthermore, effects regarding the bag 24 of the snap zipper 11 are similar in Embodiments 1 to 3.

According to the zipper in Comparative Example 6, which is made of a polyester type elastomer having a bending modulus of elasticity of more than 10,000 kg/cm$^2$, the flexibility and the engagement performance are defective and further the thermal fusion temperature is relatively high.

With zippers in Comparative Example 7 and 8, which are made of LDPE resin or PP resin, the thermal fusion performance is defective although the engagement performance is satisfactory.

EMBODIMENTS 9 TO 24

A strip-like male and also a strip-like female members 12 and 13 of each of the snap zippers 11 in individual embodiments, as shown in FIG. 1 and 2, were produced by extrusion molding using a material, which was composed of The base film 23 had a three-layer structure with two inner layers, i.e., a polyester type resin layer (53 μm) and an adhesive layer (5 μm), and an outer layer, i.e., a PET layer (12 μm), the innermost polyester type resin layer being a sealant layer of the bag body 22, to which the male or female member 12 or 13 was fused.

The product names and manufacture companies of the main and auxiliary materials used in the embodiments and comparative embodiments are as follows.

Polyester type elastomer: One-to-one blend of "HYTREL 6347" and "HYTREL 2551" by DUPONT-TORAY Co., Ltd.)

PBT resin: "BZ11" by TORAY INDUSTRIES Inc.)

LDPE: "ACEPOLYETHY F151" by Acepolymer Co., Ltd.)

L-LDPE: "MORETECH 0368R" by Idemitsu Petrochemical Co., Ltd.)

HDPE: "IDEMITSU POLYETHYLENE 540B" by Idemitsu Petrochemical Co., Ltd.)

PP: "IDEMITSU POLYPRO F-205 S" (by Idemitsu Petrochemical Co., Ltd.)

COMPARATIVE EXAMPLES 9 TO 13

As in Embodiments 9 to 24, snap zippers in the individual comparative examples s were produced. Then, by using these zippers, bags with zippers in the individual comparative examples were produced.

The kinds and proportions of the polyolefin type resins used in the individual comparative examples are shown in Table 3.

As in the above embodiments, the shape retention of the snap zipper of the individual comparative examples were evaluated. Also, the heat seal temperature was measured. The results are shown in Table 3.

EMBODIMENTS 25 TO 40

A strip-like male and a strip-like female member of each of the snap zippers in the individual embodiments were produced by using a material, which was composed of polybutylene terephthalate as a main material and a polyolefin type resin as an auxiliary material as Embodiments 9 to 24. Then, by using these zippers, bags 24 with zippers in the individual Embodiments were produced.

The kinds and proportions of the polyolefin type resins that were used in the individual embodiments are shown in Table 3.

The shape retention of the snap zippers 11 of the individual embodiments was evaluated. Also, the heat seal temperature was measured. The results are shown in Table 3.

COMPARATIVE EXAMPLES 14 TO 18

As in Embodiments 25 to 40, snap zippers in the individual comparative examples were produced. Then, by using these zippers, bags with zippers in the individual comparative examples were produced.

The kinds and proportions of the polyolefin type resins used in the individual comparative examples are shown in Table 4.

As in the above embodiments, the shape retention of the snap zipper of the individual comparative examples were evaluated. Also, the heat seal temperature was measured. The results are shown in Table 4.

TABLE 3

| | | MAIN MATERIAL | KINDS & PROPORTIONS OF THE MAIN & AUXILIARY MATERIALS (WT %) | | SHAPE RETENTION | HEAT SEAL TEMPERATURE | EVALUATION |
|---|---|---|---|---|---|---|---|
| * | 13 | POLYESTER | LDPE | 3 | C | 180° C. | B |
| | 14 | TYPE | LDPE | 10 | B | 185° C. | B |
| | 15 | ELASTOMER | LDPE | 20 | B | 190° C. | B |
| | 16 | | LDPE | 40 | B | 250° C. | B |
| * | 17 | POLYESTER | L-LDPE | 3 | C | 179° C. | B |
| | 18 | TYPE | L-LDPE | 10 | B | 168° C. | B |
| | 19 | ELASTOMER | L-LDPE | 20 | B | 165° C. | B |
| | 20 | | L-LDPE | 40 | B | 207° C. | B |
| * | 21 | POLYESTER | HDPE | 3 | C | 182° C. | B |
| | 22 | TYPE | HDPE | 10 | B | 175° C. | B |
| | 23 | ELASTOMER | HDPE | 20 | B | 170° C. | B |
| | 24 | | HDPE | 40 | B | 156° C. | B |
| * | 25 | POLYESTER | PP | 3 | C | 185° C. | B |
| | 26 | TYPE | PP | 10 | B | 195° C. | B |
| | 27 | ELASTOMER | PP | 20 | B | 218° C. | B |
| | 28 | | PP | 40 | B | 233° C. | B |
| ** | 13 | POLYESTER | NONE | 0 | F | 185° C. | F |
| | 14 | TYPE | LDPE | 80 | C | F | F |
| | 15 | ELASTOMER | L-LDPE | 80 | C | F | F |
| | 16 | | HDPE | 80 | C | F | F |
| | 17 | | PP | 80 | C | F | F |

* = EMBODIMENTS
** = COMPARATIVE EXAMPLES

TABLE 4

| | | MAIN MATERIAL | KINDS & PROPORTIONS OF THE MAIN & AUXILIARY MATERIALS (WT %) | | SHAPE RETENTION | HEAT SEAL TEMPERATURE | EVALUATION |
|---|---|---|---|---|---|---|---|
| * | 25 | POLYBUTYLENE | LDPE | 3 | B | 182° C. | B |
| | 26 | TEREPHTHALATE | LDPE | 10 | B | 195° C. | B |
| | 27 | | LDPE | 20 | B | 210° C. | B |
| | 28 | | LDPE | 40 | B | 214° C. | B |
| * | 29 | POLYBUTYLENE | L-LDPE | 3 | B | 180° C. | B |

TABLE 4-continued

| | | MAIN MATERIAL | KINDS & PROPORTIONS OF THE MAIN & AUXILIARY MATERIALS (WT %) | | SHAPE RETENTION | HEAT SEAL TEMPERATURE | EVALUATION |
|---|---|---|---|---|---|---|---|
| | 30 | TEREPHTHALATE | L-LDPE | 10 | B | 173° C. | B |
| | 31 | | L-LDPE | 20 | B | 162° C. | B |
| | 32 | | L-LDPE | 40 | B | 148° C. | B |
| * | 33 | POLYBUTYLENE | HDPE | 3 | B | 185° C. | B |
| | 34 | TEREPHTHALATE | HDPE | 10 | B | 180° C. | B |
| | 35 | | HDPE | 20 | B | 175° C. | B |
| | 36 | | HDPE | 40 | B | 161° C. | B |
| * | 37 | POLYBUTYLENE | PP | 3 | B | 185° C. | B |
| | 38 | TEREPHTHALATE | PP | 10 | B | 181° C. | B |
| | 39 | | PP | 20 | B | 170° C. | B |
| | 40 | | PP | 40 | B | 163° C. | B |
| ** | 14 | POLYBUTYLENE | LDPE | 80 | C | F | F |
| | 15 | TEREPHTHALATE | L-LDPE | 80 | C | F | F |
| | 16 | | HDPE | 80 | C | F | F |
| | 17 | | PP | 80 | C | F | F |

* = EMBODIMENTS
** = COMPARATIVE EXAMPLES

From Tables 3 and 4, it will be seen that the snap zippers 11 in each of Embodiments 9 to 40, in which the male and female members 12 and 13 are made of a material composed of (1) a polyester type elastomer and polyolefin type resin, or (2) a polybutylene terephthalate resin and polyolefin type resin, the compositions containing 3 to 50% by weight of the polyolefin type resin, the stem portions (tape portions) 14 and 17 of the male and female members 12 and 13 only have a very slight twist, thus indicating satisfactory shape retention.

Also, it will be seen that these bags 24 twist snap zippers 11 have no problem with the fusion strength between the snap zippers 11 and bag body 22. Thus, the bag body 24 is excellent in the sealing and unsealing of the snap zipper 11 and is satisfactory in appearance.

The snap zipper in Comparative Example 9 had defective shape retention because it did not contain a polyolefin type resin although it contained a polyester type elastomer.

The snap zippers in Comparative Examples 10 to 13 had some twist in the stem portion (tape portion) because the polyolefin type resin, although contained therein, exceeded the scope according to the invention in content. Further, bags with snap zippers produced by using these snap zippers had problems with the mechanical strength of fusion between the snap zipper and bag body.

The snap zippers in Comparative Examples 14 to 17 had some twist in the stem portion because their polyolefin type resin content exceeded the scope according to the invention, although they contained a polybutylene terephthalate resin and a polyolefin type resin. In addition, in this case the bag with a snap zipper had problems in the fusion strength between the snap zipper and bag body.

EMBODIMENT 41

A snap zipper 31 of Embodiment 41 is composed of strip-like male and female members 32 and 33 which are engaged with one another.

The male member 32 is a one-piece molding and has a strip-like stem portion 35 serving as a portion to be fused to a bag body 34, a head portion 36 of a heart-like sectional profile and a connecting portion 37 having a rod-like sectional profile, which connects together the portions 35 and 36.

The female member 33 is also a one-piece molding and has a strip-like stem portion 38 serving as a portion to be fused to the bag body 34, and a first and a second semicircular hook portion 39 and 41 formed on the stem portion 38 such that they face each other.

The stem portion 35 and 38 of the male and female members 32 and 33 have a two-layer structure formed with a first layer 42 to be fused to the bag body 34 and a second layer 43 laminated on the first layer 42. As for the male member 32, the second layer 43 is unitedly formed with the connecting portion 37 and the head portion 36 by the same material. Also, as for the female member 33, the second layer 43 is unitedly formed with the first and the second hook portions 39 and 41.

The first layer 42 is comprised of an ethylene-acrylic acid methyl random polymer (EMA) containing 7 wt % of acrylic acid methyl (MA).

The second layer 43, the connecting portion 37, the head portion 36 and the hooks 39 and 41 of the male and female members 32 and 33, excluding the first layer 42, are comprised of low density polyethylene (LDPE) having a bending modulus of elasticity of 1,500 kg/cm$^2$ and MI of 6 g/10 min..

The male member 32 can be produced to cause the first layer 42 and other portions 43, 37 and 36 to be fused by extrusion molding. The female member 33 can be also produced to cause the first layer 42 and other portions 43, 39 and 41 to be fused by extrusion molding.

Concerning a bag 44 with the snap zipper 31, the snap zipper 31 is adhered on the bag body 43 to fuse the first layers of the stem portions 35 and 38 of the male and female members 32 and 33 into a film 45 forming the bag body 43. The film 45 is made of polyester. The film 45 has, for example, a two-layer structure composed of a copolymer layer of polyether and an extension polyethylene terephthalate (PET) layer/polybutylene terephthalate (PBT), in which a copolymer layer of PBT and polyether effects sealing.

Various properties of the snap zipper 31 according to Embodiment 41 were evaluated. That is, rigidity of the snap zipper, repeated opening performance, an odor of the snap zipper, a adhesion strength for adhering between the portion for fusing to the bag body (the first layer) and the portion excluding the portion for fusing to the bag body (the second layer) (shortened as a stem adhesion strength in Table), heat seal performance between the snap zipper and the bag body, and the crushed degree of the snap zipper on the end of the bag are evaluated. The results are shown in Table 5 and 6.

Methods and criteria evaluating the properties of the snap zipper will be described below.

The rigidity of the snap zipper was evaluated based on the feeling of the snap zipper bent by hands as follows. It was A, i.e., the snap zipper had suitable rigidity. It was B, i.e., the snap zipper had almost suitable rigidity. It was F, i.e., the snap zipper was fairly soft or fairly hard.

The repeated opening performance was evaluated by measuring the decrease of the strength of the zipper after the zipper was opened and closed ten times repeatedly as follows. It was A, i.e., decrease of the strength was less than 0.2 kg/50 mm. It was B, i.e., decrease of the strength was less than 0.2–0.5 kg/50 mm. It was F, i.e., decrease of the strength was more than 0.5 kg/50 mm.

The odor of the snap zipper was evaluated by plural panelists as follows. It was A, i.e., it was almost odorless. It was B, i.e., it had a malic odor slightly. It was F, i.e., it had the malic odor.

The adhesion strength for adhering between the portion for fusing to the bag body and the portion excluding the portion for fusing to the bag body was evaluated by inquiring into whether the strength was larger than an engaged strength between the male and female members or not. It was A, i.e., the snap zipper had sufficient strength. It was B, i.e., the snap zipper had almost sufficient strength. It was F, i.e., the adhesion strength was weak.

The heat seal performance between the snap zipper and the bag body was evaluated by measuring the relation between a seal strength and a seal temperature of the snap zipper for the bag body made up of the copolymer layer of polyether and the extension PET layer/PBT. It was & i.e., a seal strength could be obtained more than 1 kg/15 mm although the seal temperature was less than 150° C. It was B, i.e., the seal strength could be obtained more than 1 kg/15 mm when the seal temperature was 150°–200° C. It was F, i.e., the seal strength could not reach 1 kg/15 mm although the seal temperature was more than 200° C.

The crushed degree of the snap zipper on the end of the bag was evaluated by watching the crushed state of the snap zipper directly. It was A, i.e., the crushed state was fine. It was B, i.e., the crushed state was almost fine.

EMBODIMENTS 42 TO 49

In Embodiment 41, the snap zippers according to the individual embodiments were obtained by changing the kinds and the proportions of acrylic acid ester (methacrylic acid ester) in a copolymer of ethylene and acrylic acid ester (methacrylic acid ester) as material of the first layer 42 of the stem portions 35 and 38.

That is, in additional Embodiment 42, EMA containing acrylic acid methyl (MA) of 18 wt % was used.

In Embodiment 43, EMA containing MA of 27 wt % is used.

In Embodiment 44, ethylene-methacrylic acid methyl random polymer (EMMA) containing methacrylic acid methyl (MMA) of 5 wt %. The bending modulus of elasticity of LDPE used in Embodiment 44 was 2,000 kg/cm$^2$ and the MI of LDPE used in Embodiment 44 was 6 g/10 min.

In Embodiment 45, EMMA containing MMA of 18 wt % is used.

In Embodiment 46, EMMA containing MMA of 38 wt % is used.

In Embodiment 47, ethylene-acrylic acid ethyl random polymer (EEA) containing acrylic acid ethyl (EA) of 9 wt % is used. The bending modulus of elasticity of LDPE used in Embodiment 47 was 2,500 kg/cm$^2$ and the MI of LDPE used in Embodiment 47 was 6 g/10 min.

In Embodiment 48, EEA containing EA of 19 wt % is used.

In Embodiment 49, EEA containing EA of 35 wt % is used.

Of these snap zippers 31, various properties were evaluated as Embodiment 41. The results are shown in Table 5 and 6.

COMPARATIVE EXAMPLES 18 TO 23

In Embodiment 41, the snap zippers according to the individual embodiments were obtained by changing the kinds and the proportions of acrylic acid ester (methacrylic acid ester) in copolymer of ethylene and acrylic acid ester (methacrylic acid ester) as material of the first layer 42 of the stem portions 35 and 38.

That is, in Comparative Example 18, EMA containing MA of 3 wt % is used.

In Comparative Example 19, EMA containing MA of 45 wt % is used.

In Comparative Example 20, EMMA containing MMA of 3 wt % is used.

In Comparative Example 21, EMMA containing MMA of 45 wt % is used.

In Comparative Example 22, EMA containing EA of 3 wt % is used.

In Comparative Example 23, EMA containing EA of 45 wt % is used.

Of these snap zippers 31, various properties were evaluated as Embodiment 41. The results are shown in Table 7.

TABLE 5

| | *EMB. 41 LDPE /EMA MA = 7 wt % | EMB. 42 LDPE /EMA MA = 18 wt % | EMB. 43 LDPE /EMA MA = 27 wt % | EMB. 44 LDPE /EMMA MMA = 7 wt % | EMB. 45 LDPE /EMMA MMA = 18 wt % | EMB. 46 LDPE /EMMA MMA = 38 wt % |
|---|---|---|---|---|---|---|
| RIGIDITY OF ZIPPER | A | A | A | A | A | A |
| REPEATED OPENING PERFORMANCE | A | A | A | B | A | A |
| ODOR OF ZIPPER | B | B | B | A | A | A |
| STEM ADHESION STRENGTH | A | A | B | A | A | B |
| HEAT SEAL PERFORMANCE | B | A | A | B | A | A |
| CRUSHED DEGREE | A | A | A | A | A | A |

*EMB = Embodiment

TABLE 6

| | *EMB. 47 LDPE/EEA EA = 9 wt % | EMB. 48 LDPE/EEA EA = 19 wt % | EMB. 49 LDPE/EEA EA = 35 wt % |
|---|---|---|---|
| RIGIDITY OF ZIPPER | B | A | A |
| REPEATED OPENING PERFORMANCE | B | A | A |
| ODOR OF ZIPPER | B | B | B |
| STEM ADHESION STRENGTH | A | A | B |
| HEAT SEAL PERFORMANCE | B | A | A |
| CRUSHED DEGREE | B | A | A |

*EMB = Embodiment

TABLE 7

| | *COM.EX. 18 LDPE /EMA MA = 3 WT % | COM.EX. 19 LDPE /EMA MA = 45 WT % | COM.EX. 20 LDPE /EMMA MMA = 3 WT % | COM.EX. 21 LDPE /EMMA MMA = 45 WT % | COM.EX. 22 LDPE /EEA EA = 3 WT % | COM.EX. 23 LDPE /EEA EA = 45 WT % |
|---|---|---|---|---|---|---|
| RIGIDITY OF ZIPPER ZIPPER | A | A | A | A | A | A |
| REPEATED OPENING PERFORMANCE | A | A | A | A | A | A |
| ODOR OF ZIPPER | B | B | A | A | B | F |
| STEM ADHESION STRENGTH | A | F | A | F | A | F |
| HEAT SEAL PERFORMANCE | F | A | F | A | F | A |
| CRUSHED DEGREE | A | A | A | A | A | A |

*COM.EX. = Comparative Example.

According to the snap zippers 31 of Embodiments 41 to 49, as known from 5 and 6, the strip-like stem portions 35 and 38 of the male member 32 and the female member 33 have a two-layer structure composed of the first layer 42 fused to the bag body 34 and the second layer 43 laminated on the first layer 42. Since the first layer 42 is comprised of a copolymer of ethylene and acrylic acid ester or a copolymer of ethylene and methacrylic acid ester, which copolymers respectively contain acrylic acid ester or methacrylic acid ester of 5–40%, it can be understood that the properties in points of the odor of the snap zipper 31, the adhesion strength for adhering between the first layer 42 and the second layer 43 and the heat seal performance between the snap zipper 31 and the bag body 34 are satisfactory.

Furthermore, since the portions excepting the first layer 42, are comprised of a synthetic resin having a bending modulus of elasticity of 500–5,000 kg/cm$^2$, the rigidity of the snap zipper 31 and the repeated opening performance are effected to be suitable, and also the crushed degree of the snap zipper 31 on the end of the bag body 43 is effected to be fine.

On the other hand, according to Comparative Examples 18 to 23, as known from Table 7, since the acrylic acid ester or methacrylic acid ester contained in the copolymer making the first layer is outside the range of 5–40%, there are disadvantages regarding the odor of the snap zipper 31, the adhesion strength for adhering between the first layer 42 and the second layer 43, and the heat seal performance between the snap zipper 31 and the bag body 34.

What is claimed is:

1. A snap zipper having a portion to be fused to a bag body made of a material comprising at least one of a polyester elastomer and a polybutylene terephthalate (PBT) resin, the resin in said portion to be fused having a bending modulus of elasticity of less than 10,000 kg/cm$^2$.

2. A snap zipper having a portion to be fused made of a material comprising at least one of a composition containing a polyester elastomer and a polyolefin resin and a composition containing a polybutylene terephthalate (PBT) resin and a polyolefin resin, said composition containing the polyolefin resin in an amount of 3 to 50% by weight.

3. The snap zipper according to claim 2, wherein said composition contains 10 to 40% by weight of said polyolefin resin.

4. The snap zipper according to claim 2, wherein said polyolefin is selected from the group consisting of low-density polyethylene (LDPE), linear low-density polyethylene (L-LDPE), high-density polyethylene (HDPE), ethylene-vinyl acetate copolymer (EVA), polypropylene (PP), ethylene-butene-1 copolymer, ethylene-propylene copolymer and polybutadiene (PBd).

5. The snap zipper according to claim 1, further comprising a strip-male member and a strip-female member and said portion to be fused is made of at least one of copolymer of a ethylene and acrylic acid ester and a copolymer of ethylene and methacrylic acid ester.

6. The snap zipper according to claim 5, wherein said copolymer contains 5 to 40% by weight of acrylic acid ester or methacrylic acid ester.

7. The snap zipper according to claim 5, wherein said strip-male member and said strip-female member are composed of a synthetic resin having a bending modulus of elasticity of 500 to 5,000 kg/cm$^2$.

8. The snap zipper according to claim 5, wherein said copolymer contains 5 to 40% by weight of at least one of acrylic acid ester and methacrylic acid ester and said strip-male member and said strip-female member are composed of a synthetic resin having a bending modulus of elasticity of 500 to 5,000 kg/cm$^2$.

9. The snap zipper according to claim 5, further comprising an elongate stem portion formed with a two-layer structure of a first layer as the portion for fusing to the bag body and a second layer laminated on said first layer, said first layer being composed of at least one of a copolymer of ethylene and acrylic acid ester and copolymer of a ethylene and methacrylic acid ester.

10. The snap zipper according to claim 5, wherein said copolymer of ethylene and acrylic acid ester is an ethylene-acrylic acid methyl random copolymer (EMA) or ethylene-acrylic acid ethyl random copolymer (EEA) and said copolymer of ethylene and methacrylic acid ester is an ethylene-methacrylic acid methyl random copolymer (EMMA).

11. The snap zipper according to claim 5, wherein said strip-male member and said strip-female member are composed of low-density polyethylene.

* * * * *

UNITED STATES PATENT AND TRADEMARK OFFICE

CERTIFICATE OF CORRECTION

PATENT NO. : 5,645,905
DATED : July 8, 1997
INVENTOR(S) : Toyokazu TAKUBO et al

It is certified that error appears in the above-indentified patent and that said Letters Patent is hereby corrected as shown below:

Column 16, line 57; after "at least one of" insert ---a---.

Column 16, line 58; before "ethylene" delete ---a---.

Column 17, line 10; after "acid ester and" insert ---a---.

Signed and Sealed this

Fourth Day of November, 1997

*Attest:*

Bruce Lehman

BRUCE LEHMAN

*Attesting Officer*

*Commissioner of Patents and Trademarks*